US010421273B2

(12) United States Patent
Van Brocklin et al.

(10) Patent No.: US 10,421,273 B2
(45) Date of Patent: Sep. 24, 2019

(54) METHOD AND APPARATUS TO REGULATE TEMPERATURE OF PRINTHEADS

(71) Applicant: HEWLETT-PACKARD DEVELOPMENT COMPANY, L.P., Houston, TX (US)

(72) Inventors: Andrew L. Van Brocklin, Corvallis, OR (US); Mark Hunter, Portland, OR (US); Peter James Fricke, Salem, OR (US); Adam L. Ghozeil, Corvallis, OR (US); James Michael Gardner, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/161,399

(22) Filed: Oct. 16, 2018

(65) Prior Publication Data

US 2019/0047283 A1 Feb. 14, 2019

Related U.S. Application Data

(63) Continuation of application No. 14/123,799, filed as application No. PCT/US2011/042727 on Jul. 1, 2011, now Pat. No. 10,124,582.

(51) Int. Cl.
*B41J 2/045* (2006.01)
*B41J 2/195* (2006.01)

(52) U.S. Cl.
CPC ..... *B41J 2/04563* (2013.01); *B41J 2/0458* (2013.01); *B41J 2/04528* (2013.01); (Continued)

(58) Field of Classification Search
CPC ..... B41J 2/04596; B41J 2/04598; B41J 2/04528; B41J 2/04563
See application file for complete search history.

(56) References Cited

U.S. PATENT DOCUMENTS 4,594,501 A * 6/1986 Culley ..... B41J 2/365 219/209
5,168,284 A 12/1992 Yeung
(Continued)

FOREIGN PATENT DOCUMENTS

CN 1341991 3/2002
CN 1424967 6/2003
(Continued)

*Primary Examiner* — Scott A Richmond
(74) *Attorney, Agent, or Firm* — HP Inc. Patent Department

(57) ABSTRACT

In some examples, a method of regulating a temperature of a printhead includes charging, in a first state of a temperature regulator, an analog memory to a reference voltage that corresponds to a predetermined temperature of the printhead. The temperature regulator monitors, during a second state, the temperature of the printhead, the monitoring including measuring a thermal voltage representing an actual temperature of at least a first local area of a plurality of local areas of the printhead, and comparing, with a comparator, the reference voltage to the thermal voltage to obtain a comparison result for at least the first local area. Based on the comparison result, a series of warming pulses from a warming pulse circuit to at least the first local area is selectively enabled.

20 Claims, 4 Drawing Sheets

(52) U.S. Cl.
CPC ..... *B41J 2/04588* (2013.01); *B41J 2/04596* (2013.01); *B41J 2/195* (2013.01)

(56) References Cited

U.S. PATENT DOCUMENTS

| | | | | | |
|---|---|---|---|---|---|
| 5,475,405 | A | * | 12/1995 | Widder | B41J 2/04528 347/14 |
| 5,736,995 | A | | 4/1998 | Bohorquez et al. | |
| 5,760,797 | A | * | 6/1998 | Koizumi | B41J 2/04541 347/14 |
| 6,154,229 | A | | 11/2000 | Corrigan | |
| 6,435,668 | B1 | | 8/2002 | Barbour et al. | |
| 7,510,255 | B2 | | 3/2009 | Tamura et al. | |
| 7,604,312 | B2 | | 10/2009 | Wade | |
| 7,669,955 | B2 | | 3/2010 | Sheehan et al. | |
| 2004/0032774 | A1 | * | 2/2004 | Hirano | G11C 11/5628 365/202 |
| 2005/0007403 | A1 | | 1/2005 | Lee et al. | |
| 2010/0002036 | A1 | | 1/2010 | Jeong | |
| 2010/0165053 | A1 | | 7/2010 | Bergstedt et al. | |

FOREIGN PATENT DOCUMENTS

| | | |
|---|---|---|
| CN | 101925464 | 12/2010 |
| EP | 1533121 | 5/2005 |

* cited by examiner

METHOD AND APPARATUS TO REGULATE TEMPERATURE OF PRINTHEADS

CROSS REFERENCE TO RELATED APPLICATIONS

This is a continuation of U.S. application Ser. No. 14/123,799, having a national entry date of Jun. 6, 2014, which is a national stage application under 35 U.S.C. § 371 of PCT/US2011/042727, filed Jul. 1, 2011, which are both hereby incorporated by reference in their entirety.

BACKGROUND

Inkjet printheads are commonly used for printing. It is important to keep inkjet printheads at a predetermined temperature to obtain high print quality. Inkjet printheads typically use thermal sense resistors to regulate the heating of inkjet printheads.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
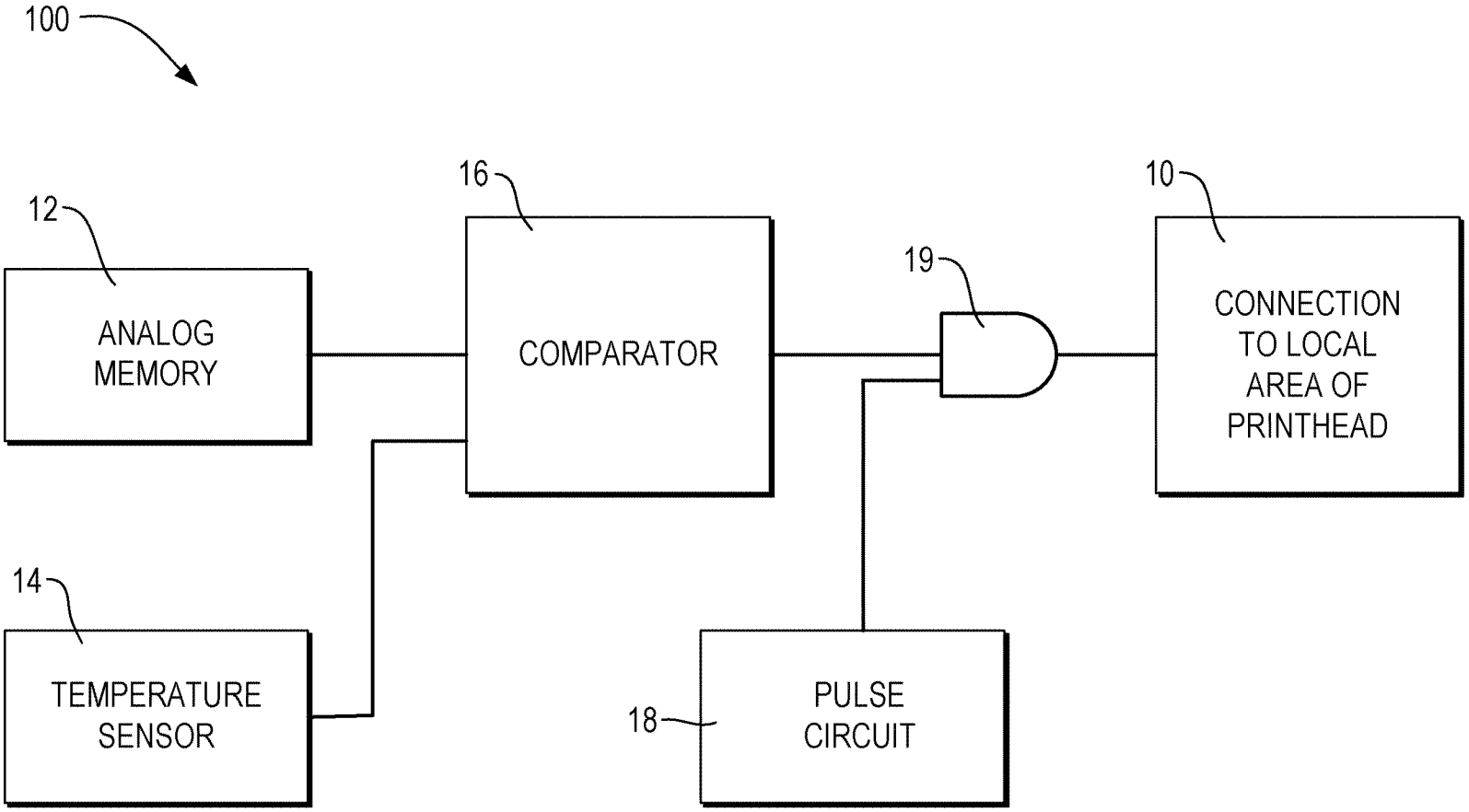
FIG. 1 illustrates a block diagram of an example apparatus.

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Inkjet printheads are commonly used for printing. The temperature of inkjet printheads are regulated to obtain high print quality. Thermal sense resistors are commonly used to regulate the heating of inkjet printheads. Due to cost constraints, typically, only one thermal sense resistor is placed on the printhead. For example, the one thermal sense resistor may regulate the temperature of the printhead by averaging the temperature across the entire printhead. The problem with using one thermal sense resistor is that the temperature across the printhead can vary to a large enough level that the temperature rises above or falls below temperatures that produce high print quality. A variation in temperature, such as a variation of three degrees Celsius outside the predetermined temperature range, may cause thermal gradients to have a visible impact on the print quality.

For example, the thermal inkjets in the center of the printhead may achieve a temperature above the temperature needed for high print quality during heavy printing due to the thermal inkjets firing more drops in the center area than the outer portions of the printhead. Conversely, the thermal inkjets on the center of the printhead may achieve a temperature below the temperature needed for high print quality during resting periods. Another factor in uneven temperature across the printhead is the ratio of inkjets to area on the printhead. At the ends of the printhead, there is larger area per inkjet nozzle, occupied with additional circuitry, electrical pads and other features, compared to the area in the center of a rib, where there is minimal area per inkjet nozzle. As such, the ends of the printhead may to be at a lower temperature than the center, especially in high density, high speed printing. Accordingly, the averaged temperature may not account for the portions of the printhead that are above or below the predetermined temperature range needed for high print quality and may cause thermal gradients across the printhead.

Regulating the temperature of the printhead across the entire printhead uniformly using a low cost method is provided herein. In examples, an apparatus, printhead, and method of regulating a temperature of an inkjet printhead is provided. In examples, the apparatus includes an analog memory, a temperature sensor, a comparator, and a pulse circuit. The analog memory is charged to a reference voltage corresponding to a predetermined temperature of a printhead. The temperature sensor measures a thermal voltage of at least one of the plurality of local areas of the printhead. The comparator obtains a comparison result by comparing the reference voltage to the thermal voltage. The pulse circuit selectively transmits a series of warming pulses to the at least one of the plurality of local areas of the printhead based on the comparison result.

FIG. 1 illustrates a block diagram of an apparatus 100. The apparatus 100 may include a temperature regulating circuitry unit usable with various printheads, such as thermal inkjet printheads. The apparatus 100 includes an analog memory 12, a temperature sensor 14, a comparator 16, a pulse circuit 18, and a connection 10 to at least one local area of a printhead. The analog memory 12 is charged to a reference voltage corresponding to a predetermined temperature of a printhead. The temperature sensor 14 measures the thermal voltage which is proportional to the temperature of at least one of the plurality of local areas of the printhead. This voltage is also referred to as the "sensing voltage." The comparator 16 obtains a comparison result by comparing the reference voltage to the thermal voltage. The pulse circuit 18 selectively transmits a series of warming pulses to the connection between the pulse circuit 18 and the at least one local area of the printhead. For example, the pulse circuit 18 may be a warming pulse circuit that is controlled by a circuit 19, such as an AND gate, which sends a signal to transmit warming pulses when the printhead is in a printing mode. The transmission of the warming pulses from the pulse circuit 18 also depends on the comparison result from the comparator 16. For example, when the comparison result indicates that the thermal voltage is at least one of equal to and greater than the reference voltage, the temperature of the local area is less than a predetermined temperature and should be heated. Accordingly, when the printhead is in the printing mode ready to send warming pulses and an output from the comparator 16, such as a Logic 1 is inputted into the AND gate, warming pulses are transmitted to the at least one local area of the printhead.

Figure 2:
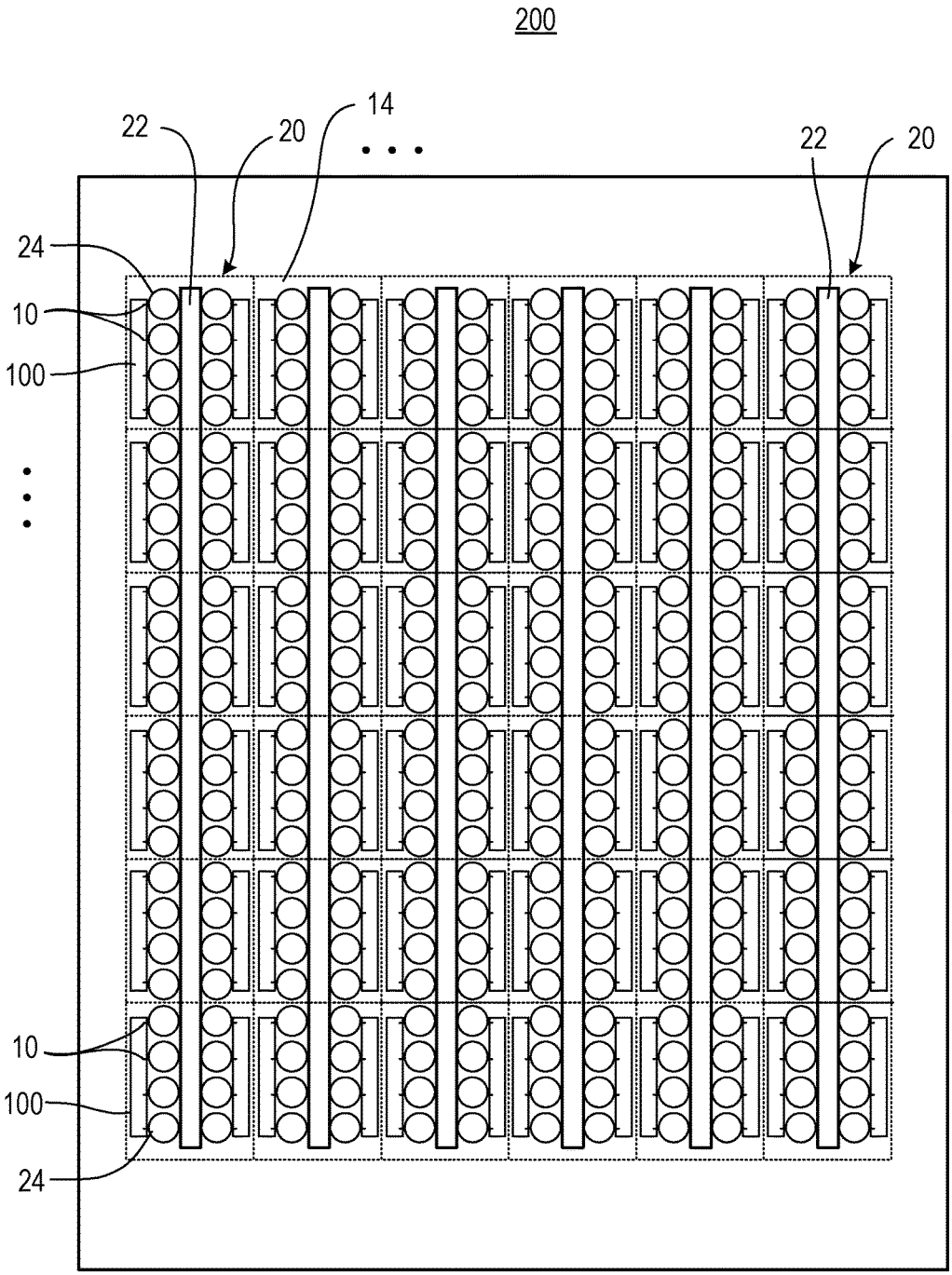
FIG. 2 illustrates a printhead including the apparatus of FIG. 1 according to an example.

FIG. 2 illustrates an example of a printhead 200 with the apparatus 100 of FIG. 1. The circuit may be placed on the printhead 200 between nozzle openings (as illustrated in FIG. 2) and/or at the ends of an inkjet printhead. The printhead 200 includes slots 22, nozzle openings 24, and silicon diodes that may be used as temperature sensors spread throughout the printhead 200 except in the areas where the slots 22 are located. The nozzle openings 24 provide channels for ejection of a fluid, such as ink, onto a media. The silicon diodes are present as the temperature sensors 14 in circuit 100, and are located adjacent to the nozzle openings 24 on the printhead 200. The silicon diodes may be, for example, forward biased silicon diodes. The silicon diodes govern the delivery of warming pulses from the apparatus 100 to heat and/or maintain the printhead 200 at a desired temperature when the printhead 200 is in a printing mode. The printing mode may include times when the printhead 200 is, for example, preparing to print and/or in the middle of a print job.

The printhead 200 is illustrated divided into a plurality of local areas 20. Each local area 20 may represent a smaller portion of the printhead 200, such as a primitive. For example, the local area 20 may be a primitive that includes a group of inkjet nozzles, such as, a group of eight thermal inkjet nozzle openings 24. The printhead 200 is divided into local areas 20 to regulate the temperature of smaller portions of the printhead 200 using the apparatus 100, such as a temperature regulating circuitry unit. By regulating the temperature of the local areas 20 of the printhead 200, the temperature of the entire printhead may be uniformly regulated without relying on, for example averages. Thus, the temperature regulation allows the local areas 20 to be heated to the predetermined temperature only when necessary and may reduce portions of the printhead having temperatures above and/or below the predetermined temperature.

Figure 3:
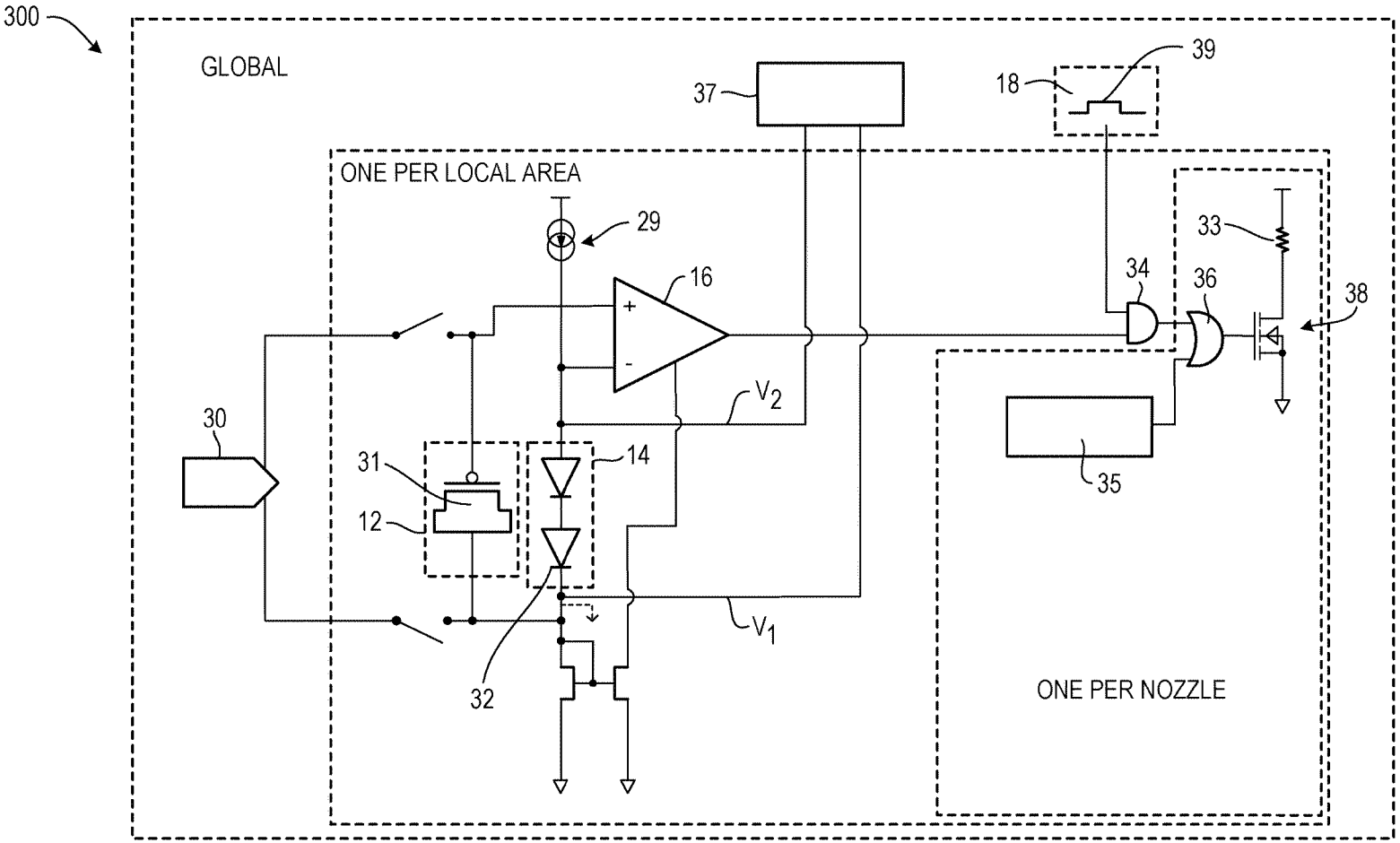
FIG. 3 illustrates an example of a temperature regulating circuitry unit for use with the printhead of FIG. 2.

FIG. 3 illustrates an example of the apparatus 100 as a temperature regulating circuitry unit 300. The temperature regulating circuitry unit 300 includes an analog memory 12, the temperature sensor 14, a comparator 16, and a pulse circuit 18. In a first state, the analog memory 12 is charged to a reference voltage which corresponding to a predetermined temperature of a printhead. The analog memory 12 may be a low cost capacitor 31, such as a metal-oxide silicon capacitor (MOSCAP), a metal oxide metal (MOM) capacitor, or a poly insulator poly (PIP) capacitor. The analog memory 12 may also store the reference voltage. For example, a closed circuit may be formed between the capacitor and a digital to analog converter 30 to charge the capacitor to the reference voltage. The digital to analog converter 30 may be a device global to the printhead that is connectable to a multitude of thermal control circuits, such that one digital to analog converter 30 may set the temperature across the entire printhead 20. The closed circuit may allow the digital to analog converter to place the reference voltage onto the capacitor corresponding to a predetermined temperature of the printhead 200 by producing a differentially driven and buffered voltage that corresponds to the desired reference voltage. The reference voltage is switched onto the capacitor, to charge the capacitor to the reference voltage. The digital to analog converter 30 may be constructed using ordinary metal oxide semiconductor field effect transistors (MOSFETs).

In a second state, the circuit between the DAC and analog memory 12 is open. The analog memory 12 transmits the reference voltage to the comparator 16 and the temperature sensor 14 transmits the thermal voltage of a local area 20 to the comparator 16. Timing signals may also be used to connect the output of the analog memory 12 to a negative input terminal of the comparator 16 and to connect the thermal voltage of the local area 20 on the printhead 200 to a positive input terminal of the comparator 16. The temperature sensor 14 measures the thermal voltage of at least one of the plurality of local areas 20 of the printhead 200. A local current source 29 provides biasing current to the silicon diodes. The thermal voltage is measured across a set of forward biased silicon diodes 32 in the at least one of the plurality of local areas 20. The forward biased silicon diodes 32 may be biased with a global current that obtains the temperature of the forward biased silicon diodes 32 in the form of a voltage. The forward biased silicon diodes 32 are used as the temperature sensor 14 for a local area 20 of the printhead 200 since the silicon diodes 32 have a strong thermal coefficient, for example approximately −2.2 mV/degree C. Additionally, the silicon diodes 32 may drive a two transistor current source and mirror the two transistor current into the comparator 16 to bias it. This alleviates the need for an extra bias circuit.

Referring to FIG. 3, the comparator 16 obtains a comparison result by comparing the reference voltage of the analog memory 12 to the thermal voltage across the forward biased silicon diodes 32. When the temperature of the printhead 200, as determined by the potential across the forward biased silicon diodes 32, goes below the predetermined temperature that is received from the analog memory 12 as a reference voltage, the comparator 16 together with AND gate 34 pass warm pulses through to the printhead 200. For example, the comparison result transmitted from the comparator 16 may be a Logic 1, which may be a digital output that indicates the temperature sensor 14 is providing a thermal voltage that is higher than the capacitor's reference voltage, indicating that the temperature at the sensor's location is lower than that indicated by the reference voltage stored on the capacitor 31. The output of the comparator 16 may be transmitted to an AND gate 34, which also receives a signal from the pulse circuit 18, illustrated as a warming pulse circuit 39, which may be global to the printhead 200. The AND gate 34 functions to allow warming pulses in a third state, when the warming pulse circuit 39 is enabled and the comparator 16 transmits a Logic 1, as described below.

In a third state, the warming pulse circuit 39 selectively transmits a series of warming pulses to the at least one local area 20 of the printhead 200 based on the comparison result. For example, when the comparison result indicates that the thermal voltage is greater than the reference voltage. The warming pulse circuit 39 may be connected to the printhead 200, such that when the comparison result indicates warming is needed, a series of warming pulses will be transmitted to a particular nozzle of the local area of the printhead 200. The warming pulses are narrow, sub firing pulses that do not provide enough energy to the thermal inkjet resistors to fire drops. The warming pulses are created globally on the printhead 200 (e.g., one pulse circuit per printhead) and are gated locally onto local areas or primitive groups of thermal inkjet resistors to heat one or more nozzles in a small section of the printhead 200 (i.e., the local area or primitive level). The narrow, sub firing pulses or warming pulses are intended to warm, but not boil ink in a printhead 200. For example, the warming pulse circuit 39 may be connected to at least one firing resistor 33 on the printhead 200 using a metal oxide semiconductor transistor 38, such as a laterally diffused metal oxide semiconductor (LDMOS) transistor, as a switch. At least one firing resistor 33 may warm that local area 20 of the printhead 200. Alternatively, a separate heater, such as a separate inkjet firing resistor 33 connected as above, may be used.

In particular, when the warming pulse circuit 39 is set as enabled, the AND gate 34 output will depend on the output of the comparator 16 (e.g., the comparison result). The output of the comparator 16 determines whether warming pulses are transmitted to the printhead 200 via an OR gate 36, if the comparator output is a logic 1, then warming pulses are passed through from the warming pulse circuit 39 to the OR gate 36. The OR gate 36 is connected to the output of the AND gate 34 and is also be connected to a firing pulse circuitry 35 on the printhead 200. When the printhead 200 is in a printing mode, the firing pulse circuitry 35 will produce firing pulses to go through the OR gate 34 to the printhead 200 to fire drops as desired. The firing pulses are longer than the warming pulses and have enough heat to cause firing of the inkjet, which fire drops of ink. The firing pulses are connected to an OR gate 34 so that the firing pulses may not be blocked.

The temperature regulating circuitry unit 300 may further include a global control unit 37 that is used for one or more printheads to receive the proportional to the temperature voltage from the temperature sensor 14 and to determine an actual temperature of the at least one of the plurality of local areas 20 of the printhead 200 using the temperature voltage, v2, and a reference voltage, v1. The actual temperature may then be obtained, for example, from a voltage sensed from the forward biased silicon diodes 32 on the printhead 200, referred to as a sensing voltage or proportional to temperature voltage. The sensing voltage from the forward biased silicon diodes 32 may be transmitted to the control unit 37. The control unit 37 may include ore or more pass gates and one control signal. The sensing voltage may be transmitted through the pass gate(s) and transmitted to an amplifier and comparator system to convert the sensing voltage from an analog signal to a digital temperature that may be obtained external to the printhead 200.

The temperature regulating circuitry unit 300 has a low cost, as each of the plurality of local areas 20 have sensing and decision making circuitry that may include twelve transistors, one to two diodes, and one capacitor. The size of the circuit is minimal due to the small number of transistors. The temperature regulating circuitry is also cost effective since the same firing resistors and LDMOS transistors may be used to send both the firing pulses and the warming pulses. Furthermore, the temperature regulating circuitry unit 300 may be easily calibrated by using a method to measure the voltage required to trip the comparator 16, such as a wafer test using a known wafer temperature. The voltage value may then be written in the non-volatile (NV) memory on each printhead 200. Additionally, the temperature regulating circuitry unit 300 may be tested using a scan method that observes the output of the comparator 16 in a testing mode.

Figure 4:
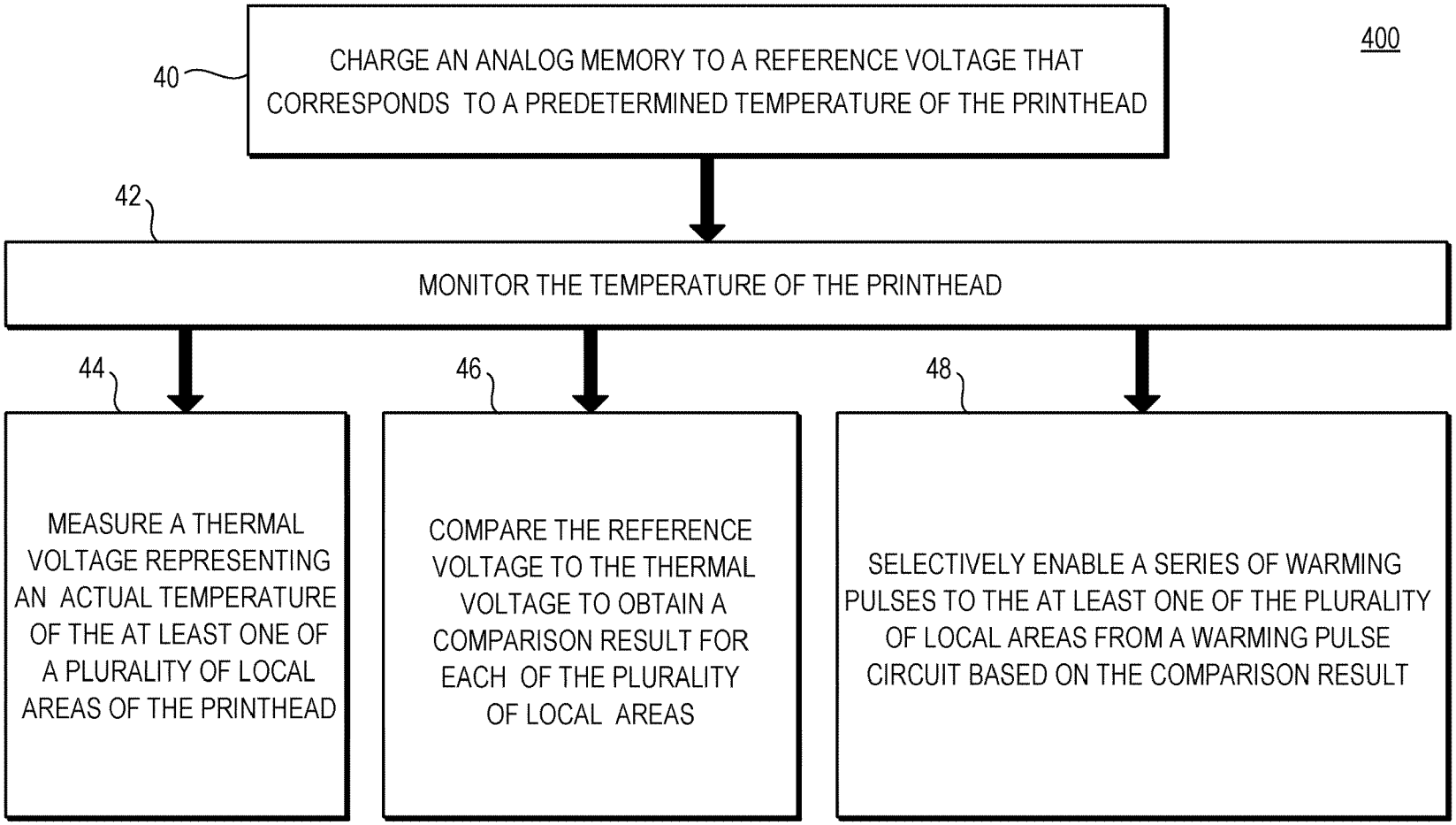
FIG. 4 illustrates a flow chart of a method to regulate temperature of a printhead according to an example.

FIG. 4 illustrates a flow chart 400 of a method to regulate the temperature of a printhead. In block 40, the method charges a capacitor to a reference voltage that corresponds to a predetermined temperature of the printhead. The capacitor may be charged with a digital to analog converter that generates the reference voltage and uses timing signals to control the voltage generation and charging of the capacitor. The timing signals may be globally generated on the printhead and direct transitioning between the first and second state of the temperature regulating circuitry unit. The method monitors the temperature of the printhead, in block 42. The monitoring may include silicon diodes that measure a thermal voltage representing an actual temperature of the at least one of a plurality of local areas, as illustrated in block 44. The thermal voltage is compared to the reference voltage by a comparator that compares the voltage on the analog memory to the thermal voltage to obtain a comparison result for each of the plurality of local areas, as illustrated in block 46. In block 48, a series of warming pulses from a warming pulse circuit are selectively enabled to transmit the series of warming pulses to the at least one of the plurality of local areas based on the comparison result. For example, when the comparison result indicates that the thermal voltage of the at least one of the plurality of local areas is at least one of equal to and greater than the reference voltage, since a lower sensing voltage means a high temperature, in which case we do not pass warming pulses. The transmission of the series of warming pulses may also depend on a switch on the printhead that may be set to enable or disable the series of warming pulses. The method may be implemented such that additional energy is only added to the portions of the printhead that require heating to keep the printhead at a predetermined temperature. By limiting the additional energy added to the printhead, the thermal gradients are reduced, which reduce the occurrences of visible print defects.

The method may also obtain the actual temperature of the at least one local areas from the thermal voltage using a temperature sensor to make the actual temperature visible outside of the temperature regulating circuitry unit. The actual temperature may then be utilized by a printing device and/or related systems, such as providing actual temperature readings to a user.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A method of regulating a temperature of a printhead, the method comprising:

charging, in a first state of a temperature regulator, an analog memory to a reference voltage that corresponds to a predetermined temperature of the printhead, the analog memory connected to a source of the reference voltage when the temperature regulator is in the first state;

controlling a transition of the temperature regulator between the first state and a second state of the temperature regulator using a timing signal from a global timing signal generator, the analog memory disconnected from the source of the reference voltage when the temperature regulator is in the second state;

monitoring, by the temperature regulator during the second state after transitioning from the first state, a temperature of the printhead, the monitoring comprising:

measuring a thermal voltage representing an actual temperature of at least a first local area of a plurality of local areas of the printhead, and comparing, with a comparator, the reference voltage to the thermal voltage to obtain a comparison result for at least the first local area; and based on the comparison result, selectively enabling a series of warming pulses from a warming pulse circuit to at least the first local area.

2. The method of claim 1, comprising measuring the thermal voltage using a temperature sensor.

3. The method of claim 2, wherein the analog memory and the temperature sensor are local to the first local area, and the reference voltage and the timing signal are global for the plurality of local areas.

4. The method of claim 1, comprising measuring the thermal voltage using a set of forward biased silicon diodes.

5. The method of claim 1, further comprising enabling a transmission of the series of warming pulses using a logic gate on the printhead, the logic gate receiving at a first input the series of warming pulses, and at a second input a signal representing the comparison result.

6. The method of claim 1, further comprising using timing signals to:

generate, with a digital to analog converter, the reference voltage, the source of the reference voltage comprising the digital to analog converter; and charge, with the digital to analog converter during the first state, the analog memory to the reference voltage.

7. The method of claim 1, wherein the analog memory comprises a capacitor.

8. The method of claim 1, wherein the reference voltage is based on a wafer test.

9. The method of claim 8, further comprising storing the reference voltage in a non-volatile memory on the printhead.

10. The method of claim 1, wherein each local area of the plurality of local areas includes a respective group of nozzles.

11. The method of claim 10, wherein each warming pulse of the series of warming pulses is a sub-firing pulse that does not provide enough energy to fire a drop from a nozzle of the group of nozzles.

12. The method of claim 1, comprising:

to set the temperature regulator in the first state, setting a switch to a closed state to connect the analog memory to the source of the reference voltage; and to set the temperature regulator in the second state, setting the switch to an open state, using the timing signal, to disconnect the analog memory from the source of the reference voltage.

13. A method of regulating a temperature of a printhead comprising a plurality of local areas, the method comprising:

charging, in a first state of a temperature regulator, a local analog memory of a first local area of the plurality of local areas to a reference voltage that corresponds to a predetermined temperature of the printhead, the local analog memory connected to a source of the reference voltage when the temperature regulator is in the first state;

controlling a transition of the temperature regulator between the first state and a second state of the temperature regulator using a timing signal from a global timing signal generator, the local analog memory disconnected from the source of the reference voltage when the temperature regulator is in the second state;

monitoring, by the temperature regulator during the second state after transitioning from the first state, a temperature of the printhead, the monitoring comprising:

measuring, using a local temperature sensor of the first local area, a thermal voltage representing an actual temperature of the first local area, and comparing, with a local comparator of the first local area, the reference voltage to the thermal voltage to obtain a comparison result for the first local area; and based on the comparison result, selectively enabling a series of warming pulses from a warming pulse circuit to the first local area.

14. The method of claim 13, wherein the series of warming pulses are to warm a printing fluid in a nozzle.

15. The method of claim 13, further comprising storing the reference voltage in a non-volatile memory on the printhead.

16. The method of claim 15, wherein the reference voltage is based on a wafer test.

17. The method of claim 13, wherein the analog memory comprises a capacitor.

18. The method of claim 13, further comprising enabling a transmission of the series of warming pulses using a logic gate on the printhead, the logic gate receiving at a first input the series of warming pulses, and at a second input a signal representing the comparison result.

19. The method of claim 18, wherein the logic gate is local to the first local area, and the series of warming pulses are global for the plurality of local areas.

20. The method of claim 13, comprising:

to set the temperature regulator in the first state, setting a switch to a closed state to connect the local analog memory to the source of the reference voltage; and to set the temperature regulator in the second state, setting the switch to an open state, using the timing signal, to disconnect the local analog memory from the source of the reference voltage.

* * * * *